US009994965B2

(12) United States Patent
Winterfeldt et al.

(10) Patent No.: US 9,994,965 B2
(45) Date of Patent: Jun. 12, 2018

(54) METHOD AND SYSTEM FOR THE PRODUCTION OF SEMI-FINISHED COPPER PRODUCTS AS WELL AS METHOD AND APPARATUS FOR APPLICATION OF A WASH

(71) Applicant: SMS group GmbH, Duesseldorf (DE)

(72) Inventors: Thomas Winterfeldt, Willich (DE); Michael Schwarze, Schwalmtal-Waldniel (DE); Hardy Jungen, Mönchengladbach (DE)

(73) Assignee: SMS group GmbH, Duesseldorf (DE)

( * ) Notice: Subject to any disclaimer, the term of this patent is extended or adjusted under 35 U.S.C. 154(b) by 510 days.

(21) Appl. No.: 14/492,253

(22) Filed: Sep. 22, 2014

(65) Prior Publication Data

US 2015/0083599 A1 Mar. 26, 2015

(30) Foreign Application Priority Data

Sep. 23, 2013 (DE) ..... 10 2013 015 640

(51) Int. Cl.

| | |
|---|---|
| ***C25D 1/00*** | (2006.01) |
| ***B22D 5/02*** | (2006.01) |
| ***B22C 23/02*** | (2006.01) |
| ***B22D 25/04*** | (2006.01) |
| ***B22C 3/00*** | (2006.01) |
| ***C25D 17/02*** | (2006.01) |
| ***B05D 1/02*** | (2006.01) |
| ***B05B 3/02*** | (2006.01) |

(Continued)

(52) U.S. Cl.

CPC ..... *C25D 1/00* (2013.01); *B05B 3/00* (2013.01); *B05D 1/02* (2013.01); *B05D 3/0254* (2013.01);

(Continued)

(58) Field of Classification Search

CPC .. B22D 25/04; B22D 5/02; B22D 5/04; C25C 1/12; C25D 1/00; C25D 17/02;

(Continued)

(56) References Cited

U.S. PATENT DOCUMENTS 3,867,977 A 2/1975 Cruz et al.
3,887,094 A * 6/1975 Ikeda ..... B65G 49/0459 134/104.3

(Continued)

FOREIGN PATENT DOCUMENTS

CA 2 568 484 C 1/2013
DE 24 12 934 C2 3/1983

(Continued)

OTHER PUBLICATIONS

European Search Report dated Sep. 4, 2015 in EP 14 40 0044, with English translation of relevant parts.

(Continued)

*Primary Examiner* — Louis J Rufo
(74) *Attorney, Agent, or Firm* — Collard & Roe, P.C.

(57) ABSTRACT

In a method for the production of semi-finished copper products, first copper is melted and cast to produce copper anodes, in one casting procedure, within multiple ingot molds, subsequently copper cathodes are formed by electrolysis, using at least one of the copper anodes, and then these copper cathodes are processed further to produce semi-finished copper products. A long-term coating is applied to at least one of the ingot molds as a wash, a sulfur-free wash is applied to the ingot mold and/or part of the work pieces cast in the ingot molds is directly processed further to produce semi-finished copper products. A method and an apparatus applies a wash to an ingot mold and a system produces semi-finished copper products.

6 Claims, 3 Drawing Sheets

(51) Int. Cl.
*B05B 3/00* (2006.01)
*C25D 17/10* (2006.01)
*B05D 3/02* (2006.01)

(52) U.S. Cl.
CPC ..... *B22C 3/00* (2013.01); *B22C 23/02* (2013.01); *B22D 5/02* (2013.01); *B22D 25/04* (2013.01); *C25D 17/02* (2013.01); *C25D 17/10* (2013.01)

(58) Field of Classification Search
CPC ..... C25D 17/10; B22C 23/00; B22C 23/02; B05B 3/00; B05B 3/0254; B05D 1/02
See application file for complete search history.

(56) References Cited

U.S. PATENT DOCUMENTS 4,178,981 A 12/1979 Murray
4,351,705 A 9/1982 Ernst et al.
H970 H * 10/1991 Snyder ..... C22B 9/10 205/43
5,536,318 A * 7/1996 Hashiuchi ..... B22C 9/06 118/214
2010/0057254 A1* 3/2010 Salamanca ..... B25J 11/00 700/245

FOREIGN PATENT DOCUMENTS

EP 1 103 325 A1 5/2001
EP 2 133 165 B1 12/2009
JP H 9-164468 A 6/1997
JP 2010-5645 A 1/2010

OTHER PUBLICATIONS

Moskalyk, R.R., Alfantazi, A.M. "Review of copper pyrometallurgical practice: today and tomorrow." Minerals Engineering. 16 (2003), 893-919.

* cited by examiner

METHOD AND SYSTEM FOR THE PRODUCTION OF SEMI-FINISHED COPPER PRODUCTS AS WELL AS METHOD AND APPARATUS FOR APPLICATION OF A WASH

CROSS REFERENCE TO RELATED APPLICATIONS

Applicants claim priority under 35 U.S.C. § 119 of German Application No. 10 2013 015 640.8 filed Sep. 23, 2013, the disclosure of which is incorporated by reference.

BACKGROUND OF THE INVENTION

1. Field of the Invention

The invention relates to a method and a system for the production of semi-finished copper products as well as to a method and an apparatus for application of a wash or coating to an ingot mold.

2. Description of the Related Art

In the case of methods and systems for the production of semi-finished copper products, it is known to first melt copper and cast it to produce copper anodes, in one casting procedure, within multiple ingot molds, subsequently to form copper cathodes by electrolysis, using at least one of the copper anodes, and then to process these copper cathodes further to produce semi-finished copper products. Furthermore for this purpose, methods and apparatuses for applying a wash (coating) to an ingot mold or to the ingot molds are also provided. Washes are coating substances that are applied to the ingot molds to make the generally porous ingot mold surface smooth before the casting process. In this connection, the technical teaching known from EP 1 103 325 A1 concerns itself with cleaning adhering residues of a wash encrustation from cast copper anodes.

The use of electrolysis, in particular, is very energy-intensive. Electrolysis therefore has a decisive influence on efficiency, in other words on the ratio of the amount of semi-finished copper products produced to the amount of energy required for this purpose.

SUMMARY OF THE INVENTION

It is the task of the present invention to increase the efficiency of copper production.

As a solution, methods and systems for the production of semi-finished copper products as well as methods and apparatuses for the application of a wash to an ingot mold, having the characteristics of the independent claims, are proposed. Further advantageous embodiments are found in the dependent claims, in the following description and in the related drawing.

In this connection, the invention proceeds from the fundamental idea that not all copper needs to be produced electrolytically, in very pure form, but rather that it is possible to further process part of the copper immediately after refining, if necessary with the addition of copper produced electrolytically, under suitable general conditions.

A method for the production of semi-finished copper products, in which first copper is melted and cast to produce copper anodes, in one casting procedure, within multiple ingot molds, subsequently copper cathodes are formed by electrolysis, using at least one of the copper anodes, and then these copper cathodes are processed further to produce semi-finished copper products, can be characterized in that a long-term coating is applied to at least one of the ingot molds as a wash.

A wash set up as a long-term coating brings with it the advantage that it can hold significantly longer, in operationally reliable manner, in comparison with known washes. In this connection, a long-term coating should be understood to be a coating with which at least two-time casting of copper into the ingot molds is possible, without significant damage or changes to the long-term coating coming about as a result. By means of the use of such a long-term coating, material introduction of wash material into the cast copper anodes that might occur can be significantly reduced as compared with known washes.

On the basis of the significant reduction in the material introduction of wash material into the copper anode, in each instance, or on the basis of the significant reduction in the contamination of the copper anodes by wash material that is possible as the result of using the long-term coating, the cast copper anode, in each instance, or the work piece cast in the ingot mold, in each instance, can be made available with significantly less contamination with wash material, in comparison with known methods.

The significantly less contamination with the wash material also—in the case of suitable general conditions—advantageously makes immediate further processing possible of at least part of the refined copper or the copper anodes or work pieces cast in the ingot molds—if necessary with the addition of electrolytically produced copper—with an acceptable or desired degree of purity of the semi-finished copper products, in each instance, specifically without prior electrolysis.

In particular, electrolysis can also be carried out with the copper anode cast in the ingot mold, using an ingot mold having the long-term coating described. This electrolysis is advantageously connected with significantly less contaminated sludge or electrolysis sludge as compared with known methods, specifically as a consequence of the low contamination of the copper anode with wash material described above.

Considered in total, the efficiency in the production of semi-finished copper products—in other words the ratio of the amount of semi-finished copper products to the amount of energy expended for producing the products—can ultimately be significantly increased due to the reduction in the energy used on the basis of what has been explained above, by application of the long-term coating as a wash to at least one of the ingot molds.

In the above method, the molten copper is preferably cast in one casting procedure, within multiple ingot molds, to produce the copper anodes. In this connection, the casting procedure can be undertaken particularly quasi-continuously or also in cycles that last a relatively short time; in particular, the casting procedure can take place or be undertaken over a period of only two to six hours, for example, whereby approx. 30 seconds to three minutes, generally around 1.5 minutes, can be required per ingot mold, for example.

This further processing of the copper cathodes to produce semi-finished copper products can comprise casting in a furnace, for example, into which the copper cathodes are introduced, whereby after casting, a semi-finished copper product in the form of a wire, for example, can be formed, by means of emptying the furnace and subsequent rolling.

A method for the production of semi-finished copper products, in which first copper is melted and cast to produce copper anodes, in one casting procedure, within multiple ingot molds, subsequently copper cathodes are formed by electrolysis, using at least one of the copper anodes, and then these copper cathodes are processed further to produce semi-finished copper products, can also be characterized in that a sulfur-free wash is applied to at least one of the ingot molds.

Contamination of the copper anodes cast in the ingot molds or contamination of the work pieces cast in the ingot molds can be effectively prevented or reduced to a minimum, in advantageous manner, by means of providing a sulfur-free wash, so that the above efficiency—particularly by means of the direct further processing of the refined copper even without electrolysis that is possible with the sulfur-free wash—can also be significantly increased by means of providing the sulfur-free wash or by means of application of a sulfur-free wash to the ingot mold, in each instance. Furthermore, a significant increase in the above efficiency is also possible in that application of a sulfur-free wash to the ingot mold, in each instance, allows electrolysis that is connected with significantly less contaminated electrolysis sludge, accompanied by a corresponding significant reduction in the energy expenditure required for electrolysis.

In a preferred embodiment, the ingot molds are passed to a casting apparatus in cycled manner, during a casting procedure, and at least part of the wash is applied outside of the cycle.

Application of at least part of the wash outside of the cycle brings with it the advantage that in contrast to known production methods, more time is available for application. As a result, application of the layer can take place in very controlled manner, accompanied by the advantageous formation of a very uniform layer that can then also guarantee corresponding useful lifetimes for its use as a long-term coating, particularly in the case of suitable process management.

In particular, at least one base layer of the wash can advantageously be applied outside of the cycle, whereby preferably, a working layer applied to the base layer is also applied outside of the cycle.

Because the base layer and, if applicable, also the working layer are applied outside of the cycle, application of these layers can take place in very controlled manner. In this way, the base layer or the working layer can advantageously be configured to be very uniform. A coating that comprises a base layer and a working layer demonstrates very great durability or operational reliability in comparison with known coatings, particularly in such a, manner that it can survive at least two-time casting of the copper in the ingot mold, in each instance, without significant wear phenomena.

As an alternative to application of the working layer to the base layer outside of the cycle, however, this can also be applied to the ingot mold, in each instance, within the cycle—in other words in the cycle during which the ingot molds are passed to the casting apparatus. This method of procedure is particularly advantageous when recoating by means of application of a working layer, particularly also to partial surfaces or partial regions of the base layer, can contribute to the quality of the cast copper anodes in the case of individual ingot molds in which great erosion of wash material occurs.

A method for the production of semi-finished copper products, in which first copper is melted and cast to produce copper anodes, in one casting procedure, within multiple ingot molds, subsequently copper cathodes are formed by means of electrolysis, using at least one of the copper anodes, and then these copper cathodes are processed further to produce semi-finished copper products, can also be characterized in that part of the work pieces cast in the ingot molds is directly processed further to produce semi-finished copper products.

Because part of the work pieces cast in the ingot molds is directly processed further to produce semi-finished copper products—in other words further processing is undertaken with bypassing of electrolysis—a significant energy saving can be implemented in producing the semi-finished copper products, because energy-intensive electrolysis is eliminated for these work pieces. This method of procedure is particularly advantageous if the work pieces cast in the ingot molds are damaged as the result of a non-uniform casting process, for example, or as the result of non-uniform removal from the ingot mold—for example using a crowbar—and cannot be suitably handled for subsequent electrolysis. In this regard, although these work pieces are not suitable for electrolysis, they might have the material quality required for the semi-finished copper products, in each instance, so that electrolytic processing can advantageously be refrained from. Considered in total, the efficiency defined above can therefore be significantly improved in the production of the semi-finished copper products, by means of bypassing of energy-intensive electrolysis.

It is advantageous if at least part of the work pieces to be processed further, directly from the copper anodes to semi-finished copper products, is processed further to produce semi-finished copper products together with the copper cathodes. In this manner, the degree of contaminants that are generally introduced into the semi-finished copper products particularly by the copper anodes can be adjusted accordingly.

The work pieces to be processed further directly to produce semi-finished copper products can be, in particular, as was already explained above, work pieces that demonstrate poor handling, for example as the result of a non-uniform casting process or non-uniform removal from the ingot mold, in each instance, and therefore are not suitable for electrolysis. A significant increase or improvement in the efficiency defined above can be implemented by the joint processing of the copper cathodes with the work pieces to be directly processed further to produce semi-finished copper products, in that these work pieces are combined, bypassing energy-intensive electrolysis, with copper cathodes made available by means of electrolysis, in order to produce the semi-finished copper products. In particular, the quality grade of the semi-finished copper products to be produced can be advantageously adapted to desired or given conditions, by a suitable combination of the work pieces with the copper cathodes or by suitable adaptation of the ratio of the number of work pieces provided directly for further processing to the number of copper cathodes.

Joint processing of the work pieces to be processed further with the copper cathodes can take place, for example, by means of mixing same in a furnace, followed by subsequent renewed casting.

In the above methods, in which it is provided to apply a long-term coating as a wash to at least one ingot mold or to multiple ingot molds, to apply a sulfur-free wash to the at least one ingot mold or to process part of the work pieces cast in the ingot molds further directly to produce semi-finished copper products, the fundamental idea that forms the basis is that not all copper must be produced electrolytically in very pure form, but rather it is possible to process part of the copper further directly after refining, if necessary also with the addition of electrolytically obtained copper, in the case of suitable general conditions.

A method for application of a wash to an ingot mold can be characterized in that the wash is applied in multiple coats, particularly two coats, as was already explained as an example above with the application of a base layer and a working layer. By means of multiple-coat application of the wash, a long-term coating can be formed, which is significantly more durable or can hold significantly longer, in operationally reliable manner, as compared with known wash coatings. In particular, such a long-term coating can withstand at least two-time casting of molten metal or molten copper into the ingot mold, in each instance, without noteworthy erosion or inclusion of wash material into the cast product, in each instance, accompanied by an advantageous increase or improvement in efficiency, as has already been explained above, in part.

A method for application of a wash to an ingot mold can also be characterized in that the wash is sprayed on sequentially, which can be particularly advantageous also when making a wash applied in multiple coats available, if applicable also only for application of one of the coats. By means of spraying it on sequentially, a coating having an advantageously low pore size and a very smooth surface can advantageously be implemented, accompanied by a significant increase in the durability of the layer, which—as has already been explained above—is also accompanied by a significant improvement in efficiency.

It is particularly advantageous if the layer thickness of the wash is controlled by controlling the movement speed during the sequential application. In this manner, a wash layer or wash coating can be created with a uniform or with an essentially uniform layer thickness, or with a layer thickness adapted to the wear of the wash, which in turn is connected with an advantageous increase in the durability or long-term strength of the applied coating.

A method for application of a wash to an ingot mold that is characterized in that the ingot mold is tempered during the application process also brings with it the advantage that the durability or long-term strength of the wash layer can be significantly improved as compared with known wash layers as the result of tempering during the application process. This in turn is connected with a significant increase in the efficiency of a method for the production of semi-finished copper products using one or more ingot molds, as has already been explained above. Tempering during the application process significantly improves the durability or long-term strength particularly as a result from applying the wash to the ingot mold, in each instance, very uniformly and in a thermodynamic state that remains the same, as a result of the tempering.

In this connection, it should be emphasized that the term "tempering" is directed, in the present case, not just at mere heating, as it is also caused, for example, during a casting procedure, by means of introduction of the copper into the ingot molds, but also at targeted adherence to specific temperatures or to a specific temperature profile, particular also temperature lowering, if necessary.

Preferably, the ingot mold is tempered to below 200° C., preferably to below 180° C., during the application process. It has been shown that in the case of tempering of the ingot mold below these temperature limits during the application process, great durability of the wash layer or wash coating made available by means of the application can be created. In particular, tempering of the ingot mold to 110° C. or to approx. 110° C. has proven to be particularly advantageous for achieving very great durability or long-term strength of the wash layer.

It is advantageous if the ingot mold is tempered, during the application process, to between 100° C. and 125° C., preferably to between 105° C. and 115° C. In these temperature ranges, the evaporation that occurs during application of the wash does not unnecessarily impair the formation of the layer. In particular, a stable and firm layer is advantageously formed. Particularly if the ingot mold is tempered to between 105° C. and 115° C. during the application process, the processes that accompany the evaporation that occurs are hardly present or not present at all. In the case of restriction to the above temperature ranges, the water vapor formation is preferably present to a degree that does not allow damaging effects on the ingot mold or on the wash layer to occur as the result of crater formation, in other words as the result of evaporation of the water present in the wash material.

Particularly preferably, the wash is applied as a base layer and as a working layer. In this manner—see also the above explanations—a very durable or operationally reliable coating, particularly in the form of a long-term coating, can be formed.

Preferably, the base layer is applied with tempering of the ingot mold to between 100° C. and 125° C., preferably to between 105° C. and 115° C., and the working layer is applied with tempering of the ingot mold to below 200° C., preferably to below 180° C.

As was already explained above, inclusion or contamination of the ingot mold that accompanies the evaporation of wash material, by embedding of wash material into the ingot molt material, can be reduced to a minimum or practically completely excluded by application of the base layer with tempering of the ingot mold to between 100° C. and 125° C., preferably to between 105° C. and 115° C. Furthermore, it has been shown that application of the working layer with tempering of the ingot mold to below 200° C., preferably to below 180° C., is accompanied by very great durability or operational reliability of the working layer, which allows at least two-time casting into the ingot mold, without any essential change in shape of the working layer or material erosion at the working layer coming about in this connection, which could have a detrimental effect on the durability or long-term strength of the working layer. The working layer, in particular, is subject to very great stresses when molten copper is cast in, because the copper comes into direct contact with the working layer, so that very great durability of this layer is therefore very advantageous.

Particularly preferably, the layer thickness of the wash is controlled by controlling the volume stream and/or the pressure of the wash. In this manner, a wash layer having a uniform thickness or a thickness adapted to the wear, in each instance, can be advantageously implemented, accompanied by the creation of a layer having a smooth surface and a very low pore size.

A system for the production of semi-finished copper products, having a refining furnace (i), having ingot molds that are disposed behind the refining furnace and can be filled from the refining furnace (ii), having an electrolysis bath (iii), having an anode transport for transport of anodes cast in the ingot molds to the electrolysis bath (iv), having a further processing device disposed after the electrolysis bath (v), and having a cathode transport for transport of cathodes from the electrolysis bath to the further processing device (vi), can be characterized in that a bypass transport is provided between the ingot molds and the further processing device, with which the work pieces cast in the ingot molds can be transported to the further processing device, bypassing the electrolysis bath.

Such a system is particularly suitable for carrying out the above method, in which part of the work pieces cast in the ingot molds is directly processed further to produce semi-finished copper products, particularly accompanied by a significant improvement in efficiency in the production of the semi-finished copper products.

The bypass transport is provided to process the work pieces cast in the ingot molds directly—in other words bypassing electrolysis—to produce semi-finished copper products. Using the bypass transport, the work pieces cast or molded in the ingot molds can be transported to the further processing device, bypassing the electrolysis bath.

The cast work pieces can particularly be work pieces that were originally supposed to be provided as anodes, but are excessively deformed as compared with a predetermined anode shape, as the result of non-uniform casting processes, for example, or as the result of other damage, for example in an attempt at removal from the ingot mold, so that they cannot be used for electrolysis. In particular, these can be work pieces on which anode ears are not present at all or not present in a desired shape, so that effective handling of the anodes by way of the anode ears, which act as hooks, is not possible. These work pieces can then be advantageously transported to the further processing device, bypassing the electrolysis bath, using the bypass transport.

Further processing of the work pieces cast in the ingot molds, to produce semi-finished copper products, can take place in the further processing device. In particular, work pieces cast in the ingot molds, which are transported to the further processing device, bypassing the electrolysis bath, can be processed further together with the copper cathodes that were formed in the electrolysis bath, by electrolysis of the copper anodes, to produce semi-finished copper products.

The further processing device can comprise a furnace, for example, into which the work pieces and/or the copper cathodes can be introduced for the purpose of liquefaction by means of heating. Furthermore, the further processing device can comprise a press and/or a casting device and/or a rolling mill, for example. A rolling mill can be a rolling mill that is set up for forming a semi-finished copper product in the form of a rod-shaped material or a wire material, for example.

The bypass that is possible by using the bypass transport can particularly be a bypass with the involvement or interposition of a temporary storage unit and/or a cleaning apparatus. In this way, the cast work pieces or the anodes or the cathodes are temporarily stored and/or cleaned during the bypass, before they reach the further processing device.

As has already been indicated above, the ingot molds that follow the refining furnace can be filled from the refining furnace, whereby filling can be undertaken in simple and practical manner, for example with the interposition of multiple vats.

The electrolysis bath can be an electrolysis bath configured in any desired manner, which is set up for producing pure or almost pure metal by means of deposition at a cathode, using the anodes cast in the ingot molds, whereby the metal can particularly be copper.

The anode transport for transport of the anodes cast in the ingot molds to the electrolysis bath can comprise any desired transport device that is set up for this functionality, in other words for transporting anodes cast in the ingot molds to the electrolysis bath. In particular, an industrial robot can be provided for this purpose, which is equipped with suction lifting tools, for example, in order to remove the anodes from the ingot molds and to transport them to the electrolysis bath or to introduce the anodes cast in the ingot molds into the electrolysis bath.

The cathode transport can also comprise any desired transport apparatus that is set up for the intended functionality, in other words for transporting cathodes from the electrolysis bath to the further processing device.

Furthermore, the bypass transport can also comprise any desired transport apparatus that is set up for transporting the work pieces cast in the ingot molds to the further processing device, bypassing the electrolysis bath. In particular, the bypass transport can also comprise an industrial robot that is provided or equipped with suction lifting tools, in order to hold the work pieces cast in the ingot molds by using suction force, and to transport them to the further processing device, bypassing the electrolysis bath, by corresponding activation of the industrial robot.

In a practical embodiment of the production system, the anode transport and the bypass transport have a common conveying device, which optionally—preferably according to parameters that can be predetermined—transports work pieces from the ingot molds to the electrolysis bath as anodes, in the direction of the further anode transport, on the one hand, and work pieces from the ingot molds in the direction of the further bypass transport, on the other hand. The direction of the further bypass transport is different than the direction of the further anode transport.

By providing the common conveying device, the anode transport and the bypass transport can be implemented in simple and practical manner. For this purpose, the conveying device is set up for optionally transporting work pieces from the ingot molds to the electrolysis bath as anodes, in the direction of the further anode transport, or to transport work pieces from the ingot molds in the direction of the further bypass transport, so that common transport paths of the anode transport and of the bypass transport can be implemented in simple and practical manner by a single common conveying device.

The conveying device can be any desired conveying device that is set up for carrying out the functionality described. For example, an industrial robot that is provided with suction lifting tools, for example, may be used in order to take the anodes cast in the ingot molds out of the ingot molds, for example, or to separate them from the ingot molds, and subsequently to transport them in the direction of the further anode transport, to the electrolysis bath. In particular, this robot or a further industrial robot—which can be provided with suction lifting tools, for example—can be provided for the purpose of taking cast work pieces out of the ingot molds or to separate them from the ingot molds, and transporting them in the direction of the further bypass transport.

Preferably, the ingot molds are disposed on a common ingot mold support. By means of placement of the ingot molds on a common ingot mold support, a very compact arrangement can be made available, with which filling of the ingot molds by way of the refining furnace or from the refining furnace is possible in simple and practical manner.

In particular, the ingot mold support can advantageously be able to rotate about a preferably vertical axis, so that by rotating the ingot mold support, each ingot mold can be brought into a planned filling position for filling the ingot mold with molten metal from the refining furnace. In this manner, a plurality of ingot molds can be filled with liquid metal and particularly with liquid copper, in simple and practical manner, by means of rotating the ingot mold support.

In a practical embodiment of the production system, an application apparatus for application of a wash is provided, the working region of which apparatus is disposed within the region of the ingot mold support.

A wash layer or wash coating can be applied to each of the ingot molds, in simple and practical manner, by an application apparatus for application of a wash, the working region of which apparatus is disposed in the region of the ingot mold support. Providing the ingot molds with the wash layer or wash coating is connected with the advantageous effects already explained above. In particular, application of the wash to the ingot mold, in each instance, in operationally reliable manner, can be implemented in that the working region of the application apparatus is disposed in the region of the ingot mold support.

In this connection, it is particularly possible, for example, to apply or regenerate a working layer during ongoing operation, if necessary even with special cooling, while a base layer and, if applicable, also a first working layer can be applied during maintenance procedures or particularly between two casting procedures.

An apparatus for application of a wash to an ingot mold can be characterized in that the application apparatus has an arm that comprises an application device and can be moved sequentially over the ingot mold.

Using an application apparatus having such an arm—in other words an arm that is stet up for moving sequentially over the ingot mold—it is possible to form a very smooth coating with wash or wash material on the ingot mold. This coating furthermore demonstrates a very small pore size. Such a wash coating or wash layer demonstrates very great durability or long-term strength, as a result of the very small pore size and particularly as the result of its very smooth configuration, so that it can particularly withstand multiple casting processes of liquid, heated metal material, without significant impairments or erosion phenomena. The application device can comprise a nozzle or a brush, for example, in order to be advantageously able to create a wash coating or wash layer having a very small pore size, in particular, by means of application of the wash.

In particular, the arm can comprise two drives that are linearly independent. By providing two drives that are linearly independent, it is possible to move the arm over the ingot mold in two dimensions, by way of the two drives, in order to provide the ingot mold, in each instance, with a wash layer in simple and practical manner. Above all, a layer or coating having a predetermined thickness distribution can be formed on an ingot mold surface, in each instance, also in simple and practical manner, by means of the mobility made available in this manner. Depending on the application case, a predetermined thickness distribution of the wash layer can significantly contribute to the quality of the cast product, in other words an anode, for example.

It is understood that at least one of the movement components, particularly a movement parallel to the movement direction of the ingot mold provided above, but possibly also both movement components can be implemented also by means of a corresponding movement of the ingot mold. Likewise, it is understood that an industrial robot or the like can also be used, if necessary.

In a further practical embodiment of the application apparatus, an ingot mold tempering unit, preferably an ingot mold heating unit, as well as an ingot mold thermometer are provided.

By providing the ingot mold tempering unit or the ingot mold heating unit, particularly in connection with an ingot mold thermometer, application of the wash can be combined with very precise temperature management of the ingot mold. In this manner, particularly the ingot mold temperatures required for the formation of a very durable coating or a coating that is strong for a long time can be predetermined by means of control and/or regulation.

All the above methods, systems, and apparatuses are based on the common fundamental idea that not all copper needs to be produced electrolytically, in very pure form, but rather that it is possible to process part of the copper further directly after refining, or with the addition of electrolytically produced copper, under suitable general conditions.

It is understood that the characteristics of the solutions described above and in the claims can also be combined, if necessary, in order to be able to implement the advantages cumulatively, accordingly.

BRIEF DESCRIPTION OF THE DRAWINGS

Further advantages, goals, and properties of the present invention will be explained using the following description of exemplary embodiments, which are particularly shown also in the attached drawing. The drawing shows.

DETAILED DESCRIPTION OF PREFERRED EMBODIMENTS

Figure 1:
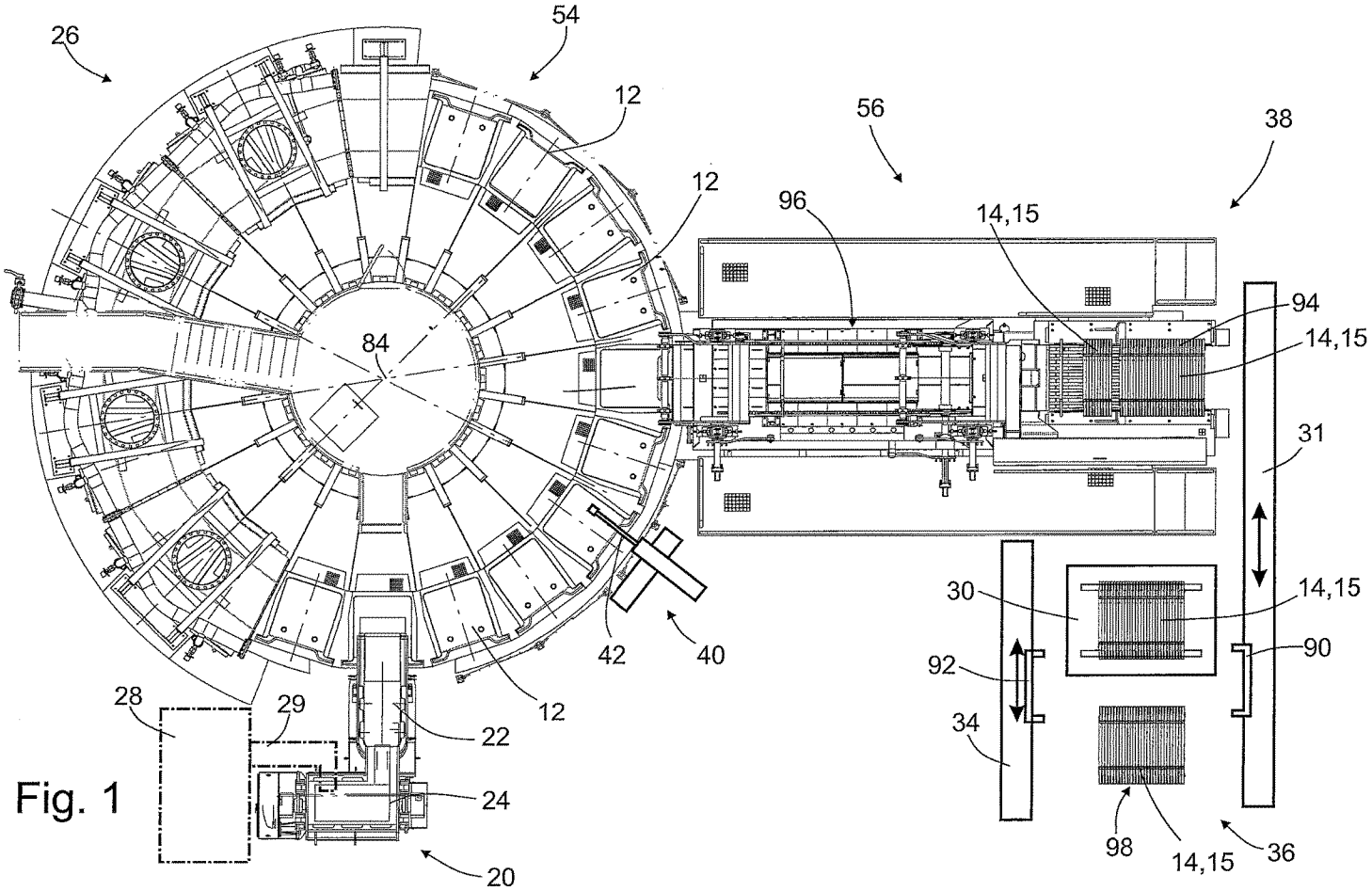
FIG. 1 a schematic top view of a part of a system for the production of semi-finished copper products.
Figure 5:
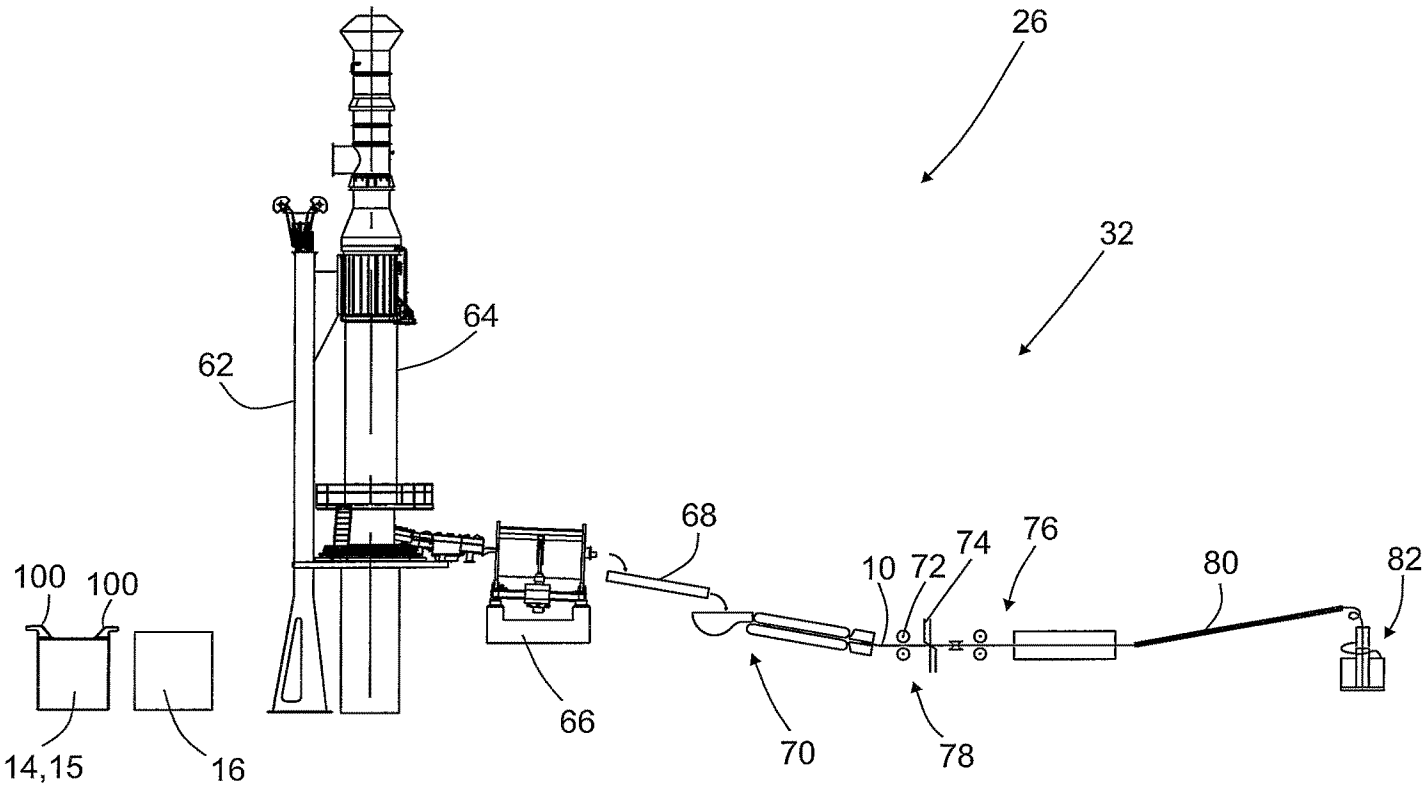
FIG. 5 a schematic view of the remaining part of the system for the production of semi-finished copper products shown in FIG. 1.

The system 26 for the production of semi-finished copper products 10 shown in FIGS. 1 and 5 (see also, in this regard, particularly FIG. 5) comprises a refining furnace 28, ingot molds 12 that follow the refining furnace 28, which can be filled from the refining furnace 28 with the interposition of a casting vat 22 and a portioning vat 24, and an electrolysis bath 30. The casting vat 22 and the portioning vat 24 are vats of a casting apparatus 20 for pouring molten metal into the ingot molds 12 or for filling the ingot molds 12 with molten metal.

The production system 26 furthermore comprises an anode transport 31 for transport of the anodes 14 cast in the ingot molds 12 to the electrolysis bath 30, a further processing device 32 that follows the electrolysis bath 30 (see FIG. 5), and a cathode transport 34 (see FIG. 1) for transport of cathodes 16 from the electrolysis bath 30 to the further processing device 32.

Furthermore, a bypass transport 36 is provided between the ingot molds 12 and the further processing device 32. This bypass transport 36 can transport work pieces 15 cast in the ingot molds 12 to the further processing device 32 (see FIG. 5), bypassing the electrolysis bath 30.

The anode transport 31 and the bypass transport 36 have a common conveying device 38, which optionally transports work pieces 14, 15 from the ingot molds 12 to the electrolysis bath as anodes 14, in the direction of the further anode transport 31, on the one hand, and work pieces 14, 15 from the ingot molds 12 in the direction of the further bypass transport 36, on the other hand.

The ingot molds 12 are disposed on a common ingot mold support 54 that can be rotated about a vertical axis 84.

The production system 26 furthermore has an application device 40 (see FIG. 1) for application of a wash 18 (see FIG. 4) to an ingot mold 12. The working region of this apparatus is disposed in the region of the ingot mold support 54 (see FIG.

Figure 2:
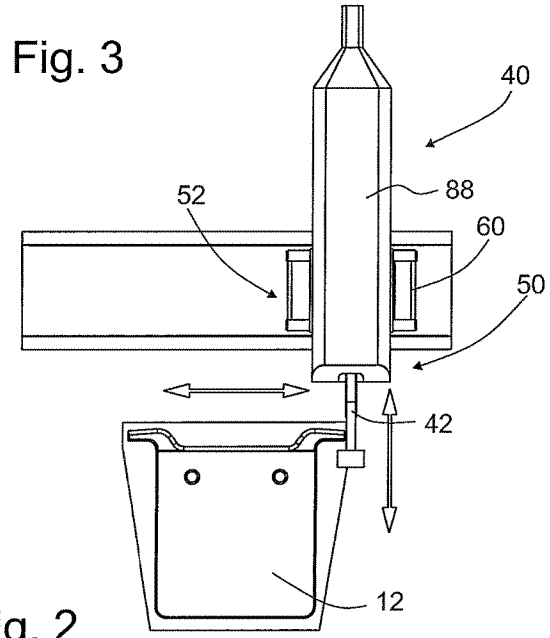
FIG. 2 the application apparatus according to FIG. 1 in a top view.

The application apparatus 40 has an arm 42 (see FIG. 4), which comprises an application device 44 having a nozzle 86 and can be moved sequentially over the ingot mold 12, in each instance. The arm 42 furthermore comprises two linearly independent drives 50, 52, in order to make two-dimensional mobility of the arm 42 over the ingot mold 12, in each instance, available (see also FIG. 2, there also in connection with the two double arrows).

The drive 52 is set up for making available straight-line mobility of the arm 42 in a direction at a right angle to the longitudinal expanse of the arm 42 or at a right angle to the longitudinal expanse of the application apparatus 40, using a carriage 60, which is affixed to a base 58 so as to move longitudinally, in the movement direction.

The drive 50 is set up for making available straight-line mobility of the arm 42 in a direction parallel to the longitudinal direction of the arm 42 or parallel to the longitudinal expanse of the application apparatus 40. The drive 50 includes a linear actuator 88 for this purpose (see FIG. 2), which is connected with the carriage 60.

Figure 4:
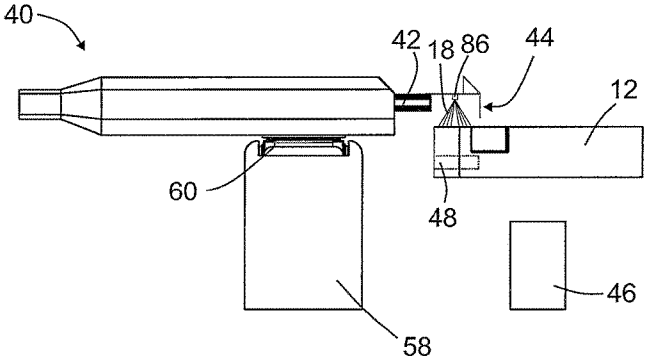
FIG. 4 the application apparatus according to FIGS. 1 to 3 in a side view.
Figure 3:
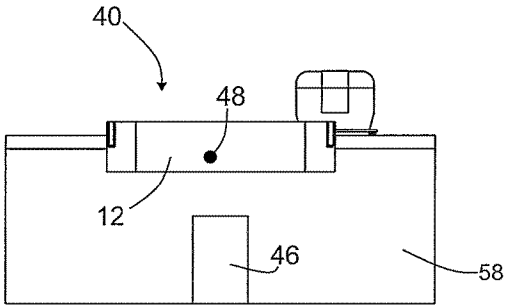
FIG. 3 the application apparatus according to FIGS. 1 and 2 in a front view.

The application apparatus 40 is furthermore provided with an ingot mold tempering unit in the form of an ingot mold heating unit 46 as well as with an ingot mold thermometer 48 (see FIGS. 3 and 4).

The further processing device 32 that follows the electrolysis bath 30 (see FIG. 5) comprises a loading apparatus 62 and a furnace 64. Copper cathodes 16, which have been formed in the electrolysis bath 30, by means of electrolysis, using copper anodes 14, can be introduced into the furnace 64 by way of the loading apparatus 62. Furthermore, copper anodes 14 or work pieces 15 can also be introduced into the furnace 64 by way of the loading apparatus 62; these copper anodes or work pieces can particularly be work pieces cast in the ingot molds 12 that are not suitable for transport to the electrolysis bath 30 as the result of non-uniform removal from the ingot molds 12, for example, or as the result of a non-uniform casting process, for example because the anode ears 100 provided for transport were not formed in the required shape. The molten metal made available by heating in the furnace 64 is passed to a casting and holding furnace 66 for further processing.

The molten metal is passed to further apparatuses of the further processing device 32 by way of the casting and holding furnace 66, specifically, in detail, to a casting channel 68, a caster 70, an ingot processing unit 78 having a guide 72 and a parting mechanism 74, a rolling mill 76, a cooling section 80, and a helical collector 82, for collecting the semi-finished copper products 10 in the form of a wire.

In a method for the production of semi-finished copper products 10 using the production system 26, first copper is melted in the refining furnace 28 and cast in one casting procedure, within multiple ingot molds 12, to produce copper anodes. To implement the casting procedure, the ingot molds 12 are filled from the refining furnace 28, specifically with the interposition of the casting vat 22 and the portioning vat 24. The ingot molds 12 are filled one after the other, in terms of time, whereby the ingot molds 12 are brought into the filling position defined by the refining furnace 28, in each instance, by means of rotating the ingot mold support 54 about the vertical axis 84.

By way of an inflow channel 29 connected with the refining furnace 28, the casting vat 22 and the portioning vat 24 can be filled with molten copper from the refining furnace, to be passed on to the ingot mold 12, in each instance. After the copper anodes 14 are cast, copper cathodes 16 are formed in the electrolysis bath 30 by electrolysis, using at least one of the copper anodes 14. These copper cathodes 16 are then processed further to produce the semi-finished copper products 10 in the form of a wire, using the further processing device 32 (see FIG. 5).

The above method is now characterized in that part of the work pieces 14, 15 cast in the ingot molds 12, which are removed from the ingot molds 12 after having been cast into the ingot molds 12 and after having reached a certain shape consistency, by means of the removal apparatus or device 56, are directly processed further to produce the semi-finished copper products 10, whereby at least part of the work pieces 15 to be directly processed further to produce semi-finished copper products 10 is processed further together with the copper cathodes 16, to produce the semi-finished copper products 10 (see also FIG. 5).

The work pieces that are processed further directly—in other words bypassing electrolysis in the electrolysis bath 30—to produce the semi-finished products 10 are—as has been explained above—particularly work pieces 15 that are not suitable for introduction into the electrolysis bath 30 by the anode transport 31, as the result of a non-uniform filling process or as the result of non-uniform removal from the ingot molds and any accompanying deformation. Likewise, of course, work pieces suitable as anodes can be processed further directly, analogously.

In order to process the work pieces 15 directly, bypassing electrolysis, to produce the semi-finished copper products 10, the work pieces 15 are transferred to a first interim storage unit 94 by means of a transfer device 96 of the conveying device 38. Proceeding from this position in the first interim storage unit 94, the work pieces 15 are brought to a second interim storage unit 98 by way of a gripper 90, in the direction of the further anode transport 31 and furthermore in the direction of the further bypass transport 36, bypassing the electrolysis bath 30. A further gripper 92, which is also provided for implementing the bypass transport 36, removes the work pieces 15 from the second interim storage unit 98 for the purpose of transport to the further processing device 32 (see FIG. 5).

Of course, the further processing in the further processing apparatus 32, bypassing electrolysis in the electrolysis bath 30, is not restricted only to the work pieces 15 that are not suitable—as was already explained above—for transport to or introduction into the electrolysis bath 30. Cast copper anodes 14 or cast products made available, in general, by casting in the ingot molds 12, in each instance, can also be processed further directly in the further processing device 32, to produce the semi-finished copper products 10, using the bypass transport 36, bypassing electrolysis.

If electrolysis is to be performed, the first gripper 90 serves for transferring the copper anode 14, in each instance, from the first interim storage unit 94 to the electrolysis bath 30. The second gripper 92 also serves—if bypassing is not intended—for removal of the copper cathode 16 made available by means of electrolysis in the electrolysis bath 30 from the electrolysis bath 30, and for the subsequent transport of the copper cathode 16 to the further processing device 32 (see FIG. 5).

In the further processing device 32, part of the work pieces 15 to be processed further directly to produce the semi-finished copper products 10 are processed further together with copper cathodes 16, to produce the semi-finished copper products 10, specifically in such a manner that the work pieces 14 and the copper cathodes 16 are introduced into the furnace 64 by means of the loading apparatus 62, and there are heated to produce a molten semi-finished product material. The molten semi-finished product material is passed to the casting and holding furnace 66 and from there passed, by way of the casting channel 68 and the caster 70, to ingot processing unit 78, from where further processing takes place in the rolling mill 76. The semi-finished product material 10, which has been processed to produce wire, is collected in a helical collector 82 after it passes through a cooling section 80.

During a casting procedure, the ingot molds 12 are passed to the casting apparatus 20 in cycled manner, with rotation of the ingot mold support 54. Outside of this cycle—in other words, in particular, during breaks in operation, for example, during which no filling of the ingot molds 12 with molten copper takes place, a long-term coating is applied to each of the ingot molds 12, as a wash, whereby the long-term coating is configured in two layers and comprises a base layer and a working layer.

The working layer is applied to the base layer after the base layer has been applied.

Application takes place using the application apparatus 40, whereby for this purpose, the arm 42 having the application device 44 is sequentially moved over the ingot mold 12, in each instance, in order to sequentially spray the wash 18 onto the ingot mold 12, in each instance, by way of the nozzle 86. In this connection, the layer thickness of the wash is controlled by means of controlling the movement speed during sequential application, among other things. Supplementally, the control of the layer thickness of the wash is improved or refined in that control of the volume stream and of the pressure of the wash 18 is also undertaken, which exits from the application device 44 by way of the nozzle 86 (see FIG. 4).

During application of the wash to the ingot molds 12 to form the long-term coating, the ingot molds 12 are tempered, in each instance. Tempering of the ingot molds 12 takes place using the ingot mold tempering unit of the application apparatus 40, in the form of the ingot mold heating unit 46. In this way, very precise temperature management is possible, particularly because the ingot mold tempering unit has a regulation device, not shown in any detail, for regulating the temperature that can be measured by the ingot mold thermometer 48.

To achieve a very durable and operationally reliable long-term coating, each of the ingot molds 12 is tempered in such a manner that the base layer is applied with tempering of the ingot molds 12 to between 105° C. and 115° C., and that the working layer is applied with tempering of the ingot molds 12 to below 180° C.

Although only a few embodiments of the present invention have been shown and described, it is to be understood that many changes and modifications may be made thereunto without departing form the spirit and scope of the invention.

What is claimed is:

1. A system for producing semi-finished copper products comprising:

(a) a refining furnace;

(b) ingot molds disposed behind and fillable from the refining furnace;

(c) an electrolysis bath;

(d) an anode transport for transport of anodes cast in the ingot molds to the electrolysis bath;

(e) a processing device disposed after the electrolysis bath for further processing of work pieces cast in the ingot molds, to produce semi-finished copper products;

(f) a cathode transport for transport of cathodes from the electrolysis bath to the processing device; and (g) a bypass transport between the ingot molds and said processing device for transporting the work pieces cast in the ingot molds to said processing device;

wherein the work pieces bypass the electrolysis bath;

wherein the anode transport and the bypass transport have a common conveying device;

wherein the common conveying device transports work pieces from the ingot molds to the electrolysis bath as anodes, in a direction of a further anode transport, and work pieces from the ingot molds in a direction of a further bypass transport different than the direction of the further anode transport.

2. The system according to claim 1, wherein the ingot molds are disposed on a common ingot mold support.

3. The system according to claim 2, further comprising an application apparatus for application of a wash, wherein the application apparatus comprises a working region disposed in a region of the ingot mold support.

4. A system for producing semi-finished copper products comprising:

(a) a refining furnace;

(b) ingot molds disposed behind and fillable from the refining furnace;

(c) an electrolysis bath;

(d) an anode transport for transport of anodes cast in the ingot molds to the electrolysis bath;

(e) a processing device disposed after the electrolysis bath for further processing of work pieces cast in the ingot molds, to produce semi-finished copper products;

(f) a cathode transport for transport of cathodes from the electrolysis bath to the processing device; and (g) a bypass transport between the ingot molds and said processing device for transporting the work pieces cast in the ingot molds to said processing device;

wherein the work pieces bypass the electrolysis bath; and wherein said further processing device comprises a furnace, a press, a casting device and/or a rolling mill.

5. The system according to claim 4, wherein the ingot molds are disposed on a common ingot mold support.

6. The system according to claim 5, further comprising an application apparatus for application of a wash, wherein the application apparatus comprises a working region disposed in a region of the ingot mold support.

* * * * *